US010578004B2

(12) United States Patent
Park

(10) Patent No.: US 10,578,004 B2
(45) Date of Patent: Mar. 3, 2020

(54) POWER BOOSTER FOR ENGINE FANS

(71) Applicant: DENSO International America, Inc., Southfield, MI (US)

(72) Inventor: Sang Bae Park, Northville, MI (US)

(73) Assignee: DENSO International America, Inc., Southfield, MI (US)

( * ) Notice: Subject to any disclaimer, the term of this patent is extended or adjusted under 35 U.S.C. 154(b) by 82 days.

(21) Appl. No.: 15/245,757

(22) Filed: Aug. 24, 2016

(65) Prior Publication Data

US 2018/0058303 A1 Mar. 1, 2018

(51) Int. Cl.
*F01P 7/04* (2006.01)

(52) U.S. Cl.
CPC ..... *F01P 7/048* (2013.01); *F01P 2025/32* (2013.01)

(58) Field of Classification Search
CPC ..... F01P 5/04; F01P 11/10; F01P 2025/08; F01P 2037/00; F01P 2005/046
See application file for complete search history.

(56) References Cited

U.S. PATENT DOCUMENTS 4,425,766 A 1/1984 Claypole
6,023,144 A * 2/2000 Imai ..... F01P 7/048 165/209
6,142,213 A * 11/2000 Gallivan ..... F01P 5/02 123/41.49
8,337,274 B1 12/2012 Wong
2003/0052629 A1* 3/2003 Hsieh ..... H02P 11/04 318/400.38
2004/0040319 A1* 3/2004 Lee ..... B60H 1/3204 62/133
2004/0196631 A1* 10/2004 Ueda ..... H05K 7/1454 361/695
2008/0121195 A1* 5/2008 Sobotzik ..... F01P 7/048 123/41.11
2011/0308763 A1* 12/2011 Charnesky ..... B60K 11/04 165/41
2012/0137993 A1* 6/2012 Kim ..... F01P 7/165 123/41.11
2016/0115856 A1* 4/2016 Ge ..... F01P 7/04 415/1
2016/0339898 A1* 11/2016 Kamado ..... F01P 5/04
2017/0167353 A1* 6/2017 Pitcel ..... F01P 1/02

* cited by examiner

*Primary Examiner* — Joseph J Dallo
*Assistant Examiner* — Kurt Philip Liethen
(74) *Attorney, Agent, or Firm* — Harness, Dickey & Pierce, P.L.C.

(57) ABSTRACT

A temperature control system for an engine of a vehicle including a fan configured to generate airflow for cooling the engine. A fan motor is configured to rotate the fan at a first speed and a second speed that is greater than the first speed. A booster is in cooperation with the fan motor and is operable to increase power to the fan motor to increase rotation of the fan from the first speed to the second speed to increase airflow to the engine.

19 Claims, 3 Drawing Sheets

POWER BOOSTER FOR ENGINE FANS

FIELD

The present disclosure relates to a power booster for engine fans.

BACKGROUND

This section provides background information related to the present disclosure, which is not necessarily prior art.

Typical vehicle cooling systems are often designed to meet extreme grade conditions (e.g., with trailer tow), so it is rare that engine cooling fan motors run at the maximum power during daily uses. This means cooling fan motors are often oversized for daily uses, and vehicles carry extra weight, resulting in increased fuel consumption. Therefore, a more efficient engine cooling fan would be desirable.

The present disclosure advantageously includes a power booster for a cooling fan motor, which when activated, will boost power to the motor, thereby increasing fan airflow. This allows the motor to be sized for daily uses, and reduces its weight and packaging space.

SUMMARY

This section provides a general summary of the disclosure, and is not a comprehensive disclosure of its full scope or all of its features. The present teachings include a power booster for a motor of an engine cooling fan. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
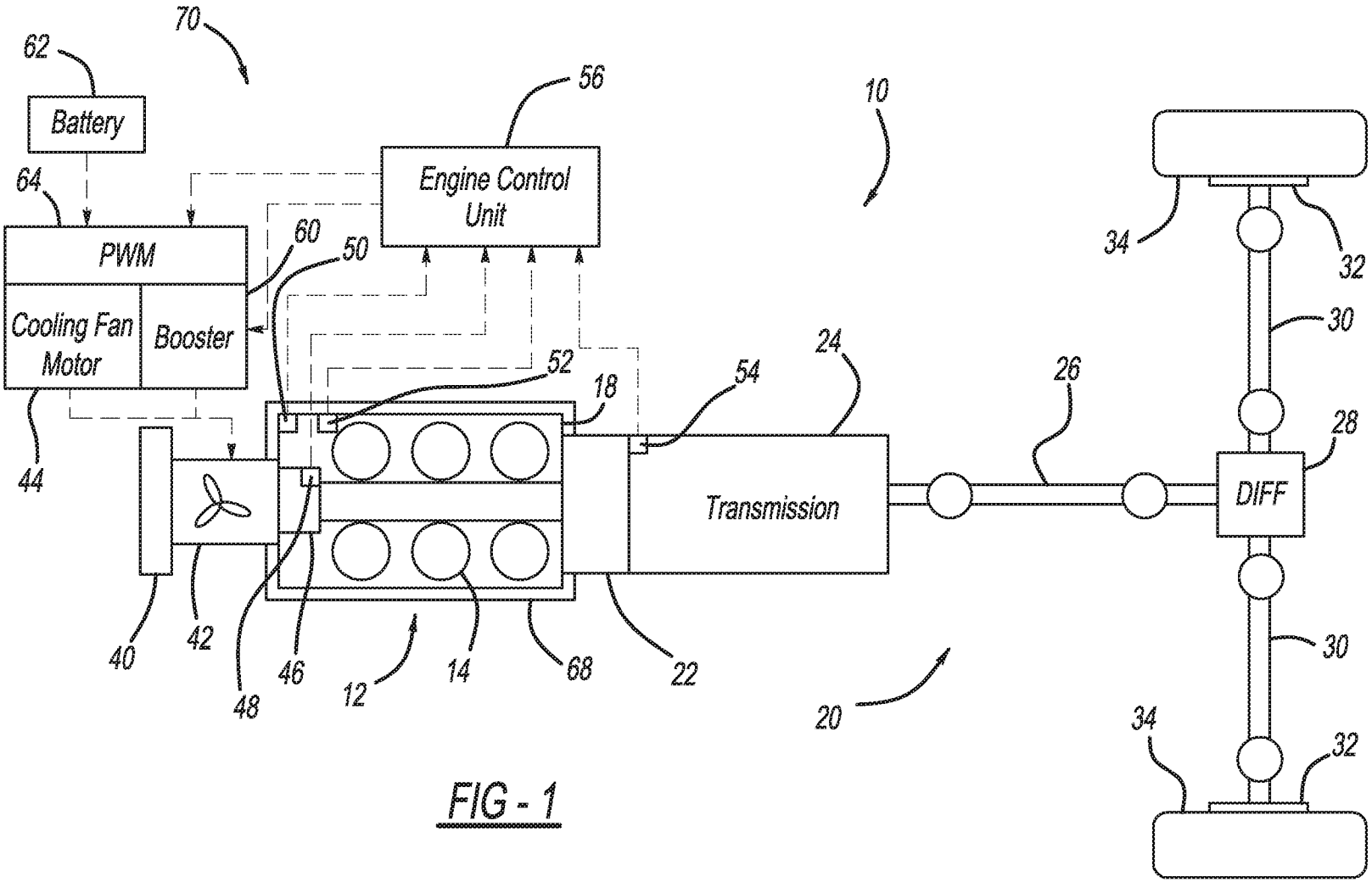
FIG. 1 is a diagram of a vehicle having a cooling fan motor, a booster and a cooling fan according to the principles of the present disclosure.

Referring now to FIG. 1, a diagram of exemplary components of a vehicle 10 is illustrated. The present teachings are applicable to any suitable type of vehicle, such as a passenger vehicle, mass transit vehicle, military vehicle, recreational vehicle, construction vehicle, etc. The vehicle 10 includes an engine 12, and a temperature control system 70 including a cooling fan 42, a cooling fan motor 44, a booster 60, and an engine control unit (ECU) 56. The engine 12 is configured to combust an air-fuel mixture within one or more cylinders 14 to produce a torque. Although the engine 12 is described as an internal combustion engine, the present teachings apply to any suitable type of engine in need of being cooled, such as a generator engine, battery pack, etc. The present teachings also apply to any system requiring a fan, such as HVAC systems, computer systems, etc. The engine 12 includes six cylinders 14 that are configured in cylinder bank 18. Although six cylinders 14 are depicted, the engine 12 may include additional or fewer cylinders 14. Furthermore, the cylinders 14 of the engine 12 may be configured in any suitable configuration, such as a V-configuration, an inline-configuration, and a flat or horizontally opposing configuration.

The engine 12 transfers torque to a driveline system 20. The driveline system 20 may include a flexplate or flywheel (not shown), a torque converter or other coupling device 22, a transmission 24, a drive or propeller shaft 26, a differential 28, axle shafts 30, brakes 32, and driven wheels 34.

Combustion of the air-fuel mixture within the cylinders 14 generates heat. Fluid (e.g., coolant) circulates through the engine 12 to absorb or extract heat from the engine 12. The fluid carries the heat to a radiator 40, where air passes through the radiator 40. As the air passes through the radiator 40, heat from the coolant may transfer into the radiator material and then as the air passes through the radiator, heat emanating from the radiator may transfer by convection into the air. In this manner, the air passing through the radiator 40 may remove heat from the coolant and cool the coolant, which may again circulate around the engine 12 to again remove heat from combustion.

Typically, little or no air passes through the radiator 40 when the vehicle 10 is stationary or moving slowly. Accordingly, the coolant may be unable to release or transfer heat when the vehicle 10 is stationary or moving slowly. To facilitate the release or transfer of heat from the coolant, the vehicle 10 includes the cooling fan 42 to facilitate airflow, i.e., increase the flow rate, through the radiator 40. Although a single cooling fan 42 is depicted, the vehicle 10 may include more than one cooling fan 42. The cooling fan 42 may be any suitable type of fan such as an axial fan, radial fan, etc. By increasing the airflow passing through the radiator 40, the cooling fan 42 facilitates transfer of heat from the coolant to air passing through the radiator 40. The increased airflow facilitated by use of the cooling fan 42 may be especially beneficial in extracting heat from the coolant when the vehicle 10 is stationary or moving slowly.

The cooling fan 42 is driven by the cooling fan motor 44, and the cooling fan motor 44 is operated by the ECU 56, or any other suitable control device. The cooling fan 42 may have a variable speed, or may operate in an on state and an off state. A battery 62 of the vehicle supplies power to the cooling fan motor 44. As one skilled in the art will appreciate, power equals voltage multiplied by current. This power from the battery 62 activates the cooling fan motor 44, and the cooling fan motor 44 supplies torque to the cooling fan 42.

The cooling fan 42 may also increase airflow within an engine compartment 68 housing the engine 12. Accordingly, the cooling fan 42 may also aid in cooling "under the hood" components associated with the engine 12, such as one or more electronic components 46. The electronic components 46 may include, for example, a motor generator unit, a starter, an ignition system, and/or a belt alternator starter (BAS). The BAS may, for example, shut down the engine 12 when the vehicle 10 is stopped, and/or start the engine 12 to accelerate the vehicle 10 from a stop.

The cooling fan motor 44 includes the booster 60, and a pulse width modulator (PWM) 64. The booster 60 and PWM 64 may be fully integrated into the cooling fan motor 44, or may be connected to the cooling fan motor 44 in any suitable manner. The booster 60 is controlled by the ECU 56, or any other suitable control device. The booster 60 is configured to increase the power supplied to the cooling fan motor 44, thus increasing the torque of the cooling fan 42 and increasing airflow through the radiator 40 and into the engine 12. The booster 60 may increase the power supplied to the cooling fan motor 44 by either increasing the current or the voltage. This increased airflow facilitates heat transfer from the coolant to the air passing through the radiator 40. The increased airflow facilitated by use of the cooling fan 42 with the booster 60 activated may be especially beneficial in extracting heat from the coolant when the vehicle 10 is experiencing extreme grade conditions (e.g., when towing a trailer). The booster 60 is operable to be activated when the engine 12 requires additional cooling air, and deactivated when the engine 12 does not require additional cooling air.

An air conditioning (A/C) head pressure sensor 48 may generate an A/C head pressure signal based upon the pressure of the coolant through an air conditioning system. Although the A/C head pressure sensor 48 is depicted as being located within the electronic components 46, the A/C head pressure sensor 48 may be located anywhere that the coolant is contained, such as within the radiator 40.

A coolant temperature sensor 50 may generate a coolant temperature signal based upon the temperature of the engine coolant. Although the coolant temperature sensor 50 is depicted as being located within the engine 12, the coolant temperature sensor 50 may be located anywhere that the coolant is contained, such as within the radiator 40.

An engine oil temperature sensor 52 may generate an engine oil temperature signal based upon the temperature of the engine oil. Although the engine oil temperature sensor 52 is depicted as being located within the engine 12, the engine oil temperature sensor 52 may be located anywhere that the engine oil is contained.

A transmission fluid temperature sensor 54 may generate a transmission fluid signal based upon the temperature of the transmission fluid. Although the transmission fluid temperature sensor 54 is depicted as being located within the transmission 24, the transmission fluid temperature sensor 54 may be located anywhere that the transmission fluid is contained.

Figure 2:
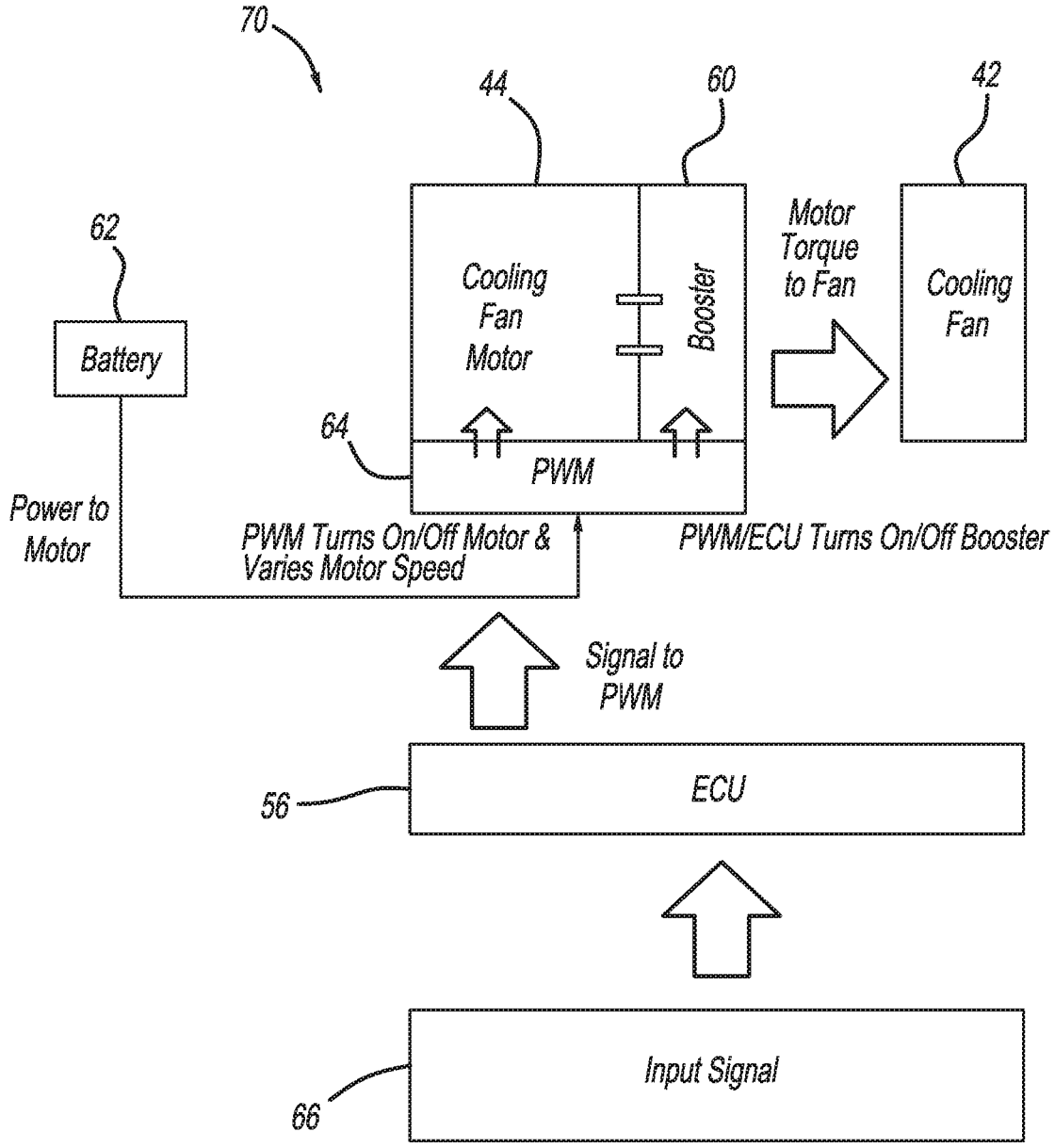
FIG. 2 is a diagram of the operation of the booster and the cooling fan of FIG. 1.

Referring now to FIGS. 1 and 2, the engine control unit (ECU) 56 receives the A/C head pressure signal, the coolant temperature signal, the engine oil temperature signal, and/or the transmission fluid temperature signal, collectively referred to as input signals 66. The ECU 56 generates a fan control signal based upon the input signals 66, to control the speed of the cooling fan 42 and either activate or deactivate the booster 60. A vehicle-specific, pre-determined threshold level may be provided to determine whether the engine 12 needs additional cooling air (i.e., whether the booster 60 needs to be activated). For example, in a typical 4-door pickup truck, the ECU 56 may activate the booster 60 when the following pre-determined threshold levels are met or surpassed: coolant temperature of at least 118° F.; transmission fluid temperature of at least 135° F.; engine oil temperature of at least 154° F.; A/C head pressure of at least 3100 kPa. These values are provided as an example, and may vary from vehicle to vehicle.

The PWM 64 is configured to receive the fan control signal, and send a signal to the motor via an oscillator (not shown) to control the cooling fan motor 44 and the booster 60 based on the fan control signal. When the engine is operating under normal conditions and requires little or no cooling air, the PWM 64 controls the cooling fan motor 44 to operate at a low speed or in the off state. When the fan control signal indicates that the engine requires cooling air, the PWM 64 operates the cooling fan motor 44 in the on state and/or increases the speed of the cooling fan motor 44. When the fan control signal indicates that the pre-determined threshold levels are met or surpassed and the engine requires additional cooling air, the PWM 64 activates the booster 60. The PWM 64 is configured to not only turn the fan 42 on and off, but also generates varying input voltage for the motor 44 according to signals from the ECU 56. The PWM 64 has a defined function and controls the cooling fan speed linear to ECU signals.

Furthermore, the PWM 64 may be configured to reduce Noise, Vibration and Harshness (NVH). NVH is caused when the frequency of the cooling fan motor 44 is in resonance with the frequency of the engine 12. The ECU 56 communicates with the PWM 64, to ensure that the frequency of the cooling fan motor 44 is not in resonance with the frequency of the engine 12, resulting in a reduction of NVH.

Figure 3:
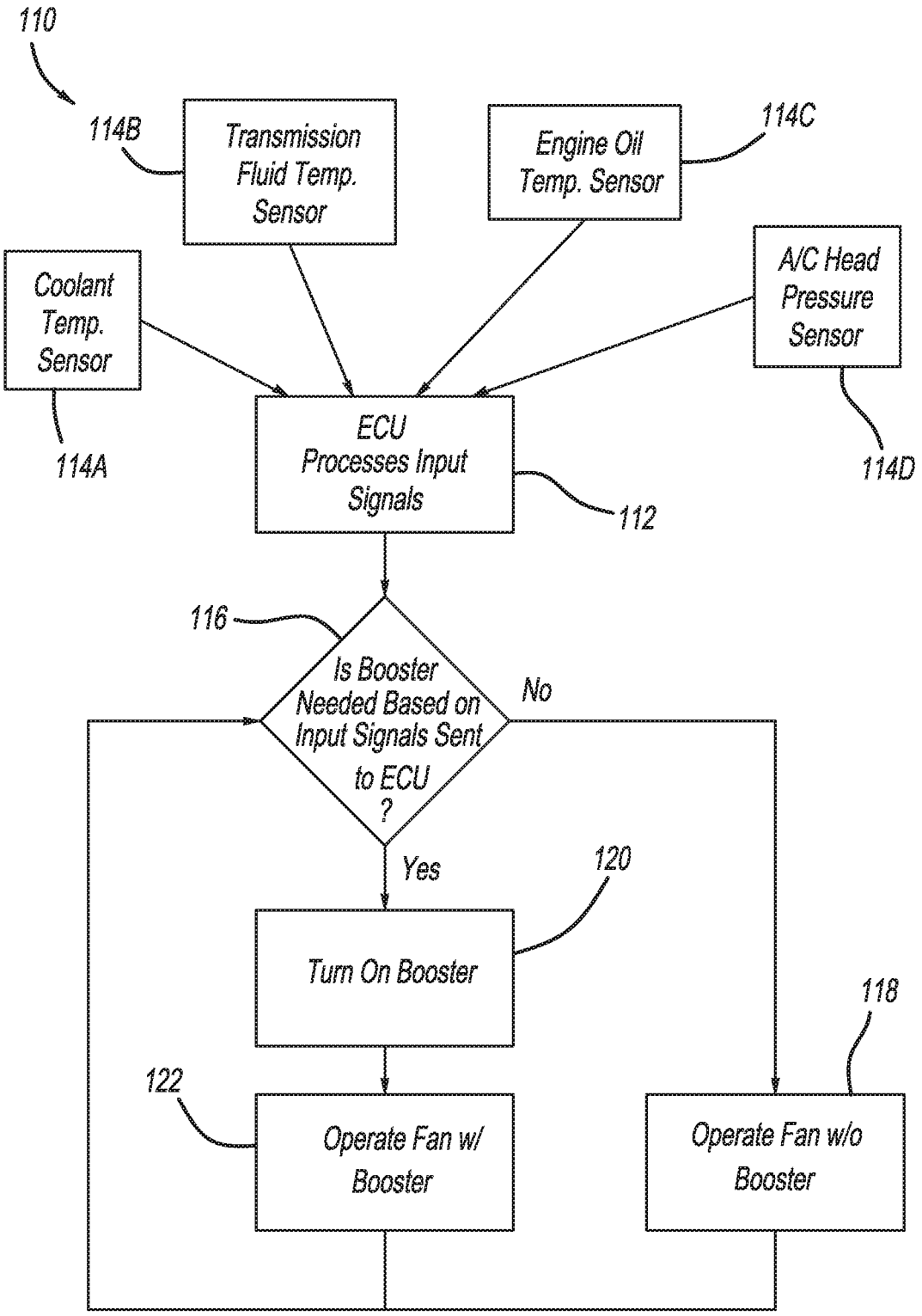
FIG. 3 is a decision flowchart of the operation of the booster and the cooling fan of FIG. 1.

Referring now to FIG. 3, a flowchart showing an exemplary decision process or method for operating the cooling fan 42 and booster 60 is depicted at reference number 110. The sensors collect the data at blocks 114A, 114B, 114C, and 114D, and send the input signals 66 to the ECU 56 at block 112. At block 116, the ECU 56 decides whether or not the booster 60 is needed based on the input signals 66. Upon determining that the booster 60 is required (i.e., when the pre-determined threshold levels have been breached), the ECU 56 sends the fan control signal to the PWM 64 at block 120 to operate the cooling fan 42 with the booster 60 activated. The PWM 64 then sends a signal to the cooling fan motor 44 at block 122, operating the cooling fan 42 and activating the booster 60. Alternatively, upon determining that the booster 60 is not required (i.e., when the pre-determined threshold levels have not been breached), the ECU 56 sends the fan control signal to the PWM 64 at block 118 to operate the cooling fan 42 without the booster 60 activated. The PWM 64 then sends a signal to the cooling fan motor 44, operating the cooling fan 42 in the on state or off state without the booster 60 activated. The booster 60 can be turned on or off by either the PWM 64 or the ECU 56 depending on, for example, vehicle architecture. If the PWM 64 continuously receives a maximum duty signal after the motor 44 has been running at full speed (without the booster 60) for a certain (extended) time period, the PWM 64 can turn on the booster 60 to increase cooling airflow.

Regardless of vehicle speed, the cooling fan 42 operates based on signals from the ECU 56 generated by fluid temperatures and a/c pressure. For example, a battery of an electric vehicle (EV) needs to be cooled while being charged overnight, and the cooling fan 42 is used to cool down the EV battery. A vehicle traveling uphill with a trailer in tow will need more than ram air, and thus the fan 42 will be operated to cool the engine 12.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A temperature control system for an engine of a vehicle, comprising:

a fan configured to generate airflow for cooling the engine;

a fan motor configured to rotate the fan at a first speed and a second speed that is greater than the first speed;

a single power supply unit for powering the fan motor;

a booster in cooperation with the single power supply unit and the fan motor, and operable to increase power to the fan motor from the single power supply unit to increase rotation of the fan from the first speed to the second speed to increase airflow to the engine; and a pulse width modulator configured to receive a fan control signal from an engine control unit, and control the fan motor and the booster based on the fan control signal;

wherein the engine control unit is configured to control the pulse width modulator by way of the fan control signal to operate the fan motor at a fan motor frequency that is not in resonance with an engine frequency of the engine;

wherein the pulse width modulator and the booster are integrated into the fan motor.

2. The temperature control system of claim 1, wherein the engine control unit is configured to activate the booster by sending the fan control signal to the pulse width modulator to increase rotation of the fan from the first speed to the second speed when the engine requires additional cooling air, and deactivate the booster to decrease rotation of the fan from the second speed to the first speed when the engine does not require additional cooling air.

3. The temperature control system of claim 2, further comprising a plurality of sensors configured to collect a set of data from the vehicle and send the set of data to the engine control unit.

4. The temperature control system of claim 3, wherein the engine control unit is configured to activate and deactivate the booster based upon the set of data.

5. The temperature control system of claim 3, wherein the plurality of sensors comprises a coolant temperature sensor, a transmission fluid temperature sensor, an engine oil temperature sensor, and an A/C head pressure sensor.

6. The temperature control system of claim 1, wherein the fan is an axial fan and the fan motor is an electric motor.

7. The temperature control system of claim 1, further comprising a radiator, wherein the fan is configured to increase airflow through the radiator.

8. The temperature control system of claim 1, wherein the engine requires additional cooling air when a pre-determined threshold is breached, the pre-determined threshold varying from vehicle to vehicle.

9. A temperature control system for an engine of a vehicle, comprising:

a fan configured to generate airflow for cooling the engine;

a fan motor configured to rotate the fan at a first speed and a second speed that is greater than the first speed;

a single power supply unit for powering the fan motor;

a booster in cooperation with the single power supply unit and the fan motor and operable to increase a power to the fan motor from the single power supply unit to increase rotation of the fan from the first speed to the second speed to increase airflow to the engine;

a plurality of sensors configured to collect a set of data from the vehicle;

an engine control unit configured to activate the booster to increase rotation of the fan from the first speed to the second speed when the engine requires additional cooling air, and deactivate the booster to decrease rotation of the fan from the second speed to the first speed when the engine does not require additional cooling air; and a pulse width modulator configured to receive a fan control signal from the engine control unit, and control the fan motor and the booster based on the fan control signal;

wherein the engine control unit is configured to control the pulse width modulator by way of the fan control signal to operate the fan motor at a fan motor frequency that is not in resonance with an engine frequency of the engine;

wherein the plurality of sensors are configured to send the set of data to the engine control unit, and the engine control unit is configured to receive the set of data; and wherein the pulse width modulator and the booster are integrated into the fan motor.

10. The temperature control system of claim 9, wherein the fan is an axial fan and the fan motor is an electric motor.

11. The temperature control system of claim 9, wherein the engine control unit is configured to activate and deactivate the booster based upon the set of data.

12. The temperature control system of claim 9, further comprising a radiator, wherein the fan is configured to increase airflow through the radiator.

13. The temperature control system of claim 9, wherein the engine requires additional cooling air when a pre-determined threshold is breached, the pre-determined threshold varying from vehicle to vehicle.

14. The temperature control system of claim 9, wherein the plurality of sensors comprises a coolant temperature sensor, a transmission fluid temperature sensor, an engine oil temperature sensor, and an A/C head pressure sensor.

15. A method for operating a temperature control system for an engine of a vehicle, comprising:

powering a fan motor of a fan with a single power supply unit;

operating the fan motor of the fan at a first speed to generate a first rate of airflow for cooling the engine;

activating a booster to increase power to the fan motor from the single power supply unit to increase rotation of the fan from the first speed to a second speed to increase airflow to the engine from the first rate of airflow to a second rate of airflow that is greater than the first rate of airflow, the booster is in cooperation with the single power supply unit and the fan motor; and controlling the fan motor and the booster with a pulse width modulator, the pulse width modulator configured to receive a fan control signal from an engine control unit, and control the fan motor and the booster based on the fan control signal; and controlling the pulse width modulator by way of the fan control signal generated by the engine control unit to operate the fan motor at a fan motor frequency that is not in resonance with an engine frequency of the engine;

wherein the pulse width modulator and the booster are integrated into the fan motor.

16. The method for operating a temperature control system of claim 15, wherein activating the booster is controlled by the engine control unit which is configured to activate the booster by sending the fan control signal to the pulse width modulator to increase rotation of the fan from the first speed to the second speed when the engine requires additional cooling air.

17. The method for operating a temperature control system of claim 16, wherein the engine requires additional cooling air when a pre-determined threshold is breached, the pre-determined threshold varying from vehicle to vehicle.

18. The method for operating a temperature control system of claim 16, wherein a plurality of sensors are configured to collect a set of data from the vehicle and send the set of data to the engine control unit, and the engine control unit is configured to activate the booster based upon the set of data.

19. The method for operating a temperature control system of claim 17, wherein the plurality of sensors comprises a coolant temperature sensor, a transmission fluid temperature sensor, an engine oil temperature sensor, and an A/C head pressure sensor.

* * * * *